United States Patent [19]

Rosenbaum

[11] Patent Number: 4,961,277

[45] Date of Patent: Oct. 9, 1990

[54] QUICK RELEASE SAFETY DEVICE FOR HANDGUNS

[76] Inventor: Nathan Rosenbaum, 6401 SW. 82nd St., Miami, Fla. 33143

[21] Appl. No.: 459,334

[22] Filed: Dec. 29, 1989

[51] Int. Cl.[5] ..... F41A 17/74

[52] U.S. Cl. ..... 42/70.11

[58] Field of Search ..... 42/70.11

[56] References Cited

U.S. PATENT DOCUMENTS

| | | | |
|---|---|---|---|
| 3,022,598 | 2/1962 | Wikstrom | 42/70.11 |
| 3,038,771 | 8/1977 | Miller | 42/70.11 |
| 3,708,901 | 1/1973 | Wolter | 42/70.11 |
| 3,720,014 | 3/1973 | Goodrich | 42/70.11 |
| 4,224,753 | 9/1980 | Bielman | 42/70.11 |
| 4,392,318 | 7/1983 | Daniels | 42/70.11 |
| 4,395,837 | 8/1983 | Durnal | 42/70.11 |
| 4,412,397 | 11/1983 | Bayn | 42/70.11 |
| 4,569,144 | 2/1986 | Thurber | 42/70.11 |
| 4,908,971 | 3/1990 | Chaney | 42/70.11 |

*Primary Examiner*—Charles T. Jordan
*Assistant Examiner*—Richard W. Wendtland
*Attorney, Agent, or Firm*—Neuman, Williams, Anderson & Olson

[57] ABSTRACT

A child-resistant safety device for attachment to firearms having a barrel with a muzzle and a cocking mechanism such as a hammer, for temporarily rendering the firearm inoperative, but which may be quickly removed by an adult to enable the firearm to be operated. The device comprises a block adapted to lie against the muzzle of the gun, and a strap having a first portion adapted to extend behind the cocking mechanism of the gun and a second portion adapted to extend from the first portion to the block. Fasteners extend through the block into engagement with the strap to hold it firmly behind the hammer, and a releasable cap is secured on the block through interengaged detents to prevent removal of the cap from the block. A pin carried by the cap extends through the block and into the muzzle of the gun to prevent removal of the cap and block from the muzzle of the gun, and thus prevent removal of the strap from the cocking mechanism. The cap is removable from the block by squeezing the cap to disengage the detents, whereby the block and strap may be removed from the firearm to enable it to be fired.

13 Claims, 3 Drawing Sheets

QUICK RELEASE SAFETY DEVICE FOR HANDGUNS

FIELD OF THE INVENTION

This invention relates to safety devices for firearms, and more particularly, to a quick release safety device for attachment to handguns to render them temporarily inoperable.

DESCRIPTION OF THE PRIOR ART

The accidental discharge of firearms results in numerous deaths and injuries each year. Many people maintain loaded firearms in their homes as a means of protection, while others possess firearms for sport or hunting. Handguns, in particular, because of their small size and light weight, are more likely to be handled by small children, who sometimes retrieve them from their parent's belongings and in response to their innate curiosity begin playing or experimenting with the gun.

If the firearm is kept for protection, it is likely that it will be kept loaded and in a readily accessible place. Otherwise, the purpose of having the gun is defeated, since a responsible adult would not have ready access to an operable firearm. Consequently, there is increased danger that a small child will gain access to the gun.

In response to these problems, numerous devices have been developed in the prior art for rendering firearms, and especially handguns, temporarily inoperative. Some of these devices can be applied to a loaded gun and quickly removed when it is desired to fire the gun. Other devices require that the firearm be in an unloaded condition, or require substantial effort and time to remove the disabling device and render the firearm operable. Examples of some prior art devices are disclosed in the following U.S. Pat. Nos.: 3,022,598, 3,708,901, 3,720,014, 4,038,771, 4,224,753, 4,395,837, 4,412,397 and 4,569,144. Many of these devices are complicated and expensive in construction, and some even require tools for their removal. Others, while intended to be child-resistant, are constructed such that they may be removed under some circumstances by a child, thus defeating their purpose.

Accordingly, there is a need for a safety device to temporarily render a firearm inoperable, that is simple and economical in construction, child-proof, and capable of being quickly removed by an adult to immediately render the firearm operable.

SUMMARY OF THE INVENTION

Therefore, an object of the invention is to provide a simple and inexpensive device that may be applied to a handgun to render it temporarily inoperative, but which may quickly and easily be removed by an adult.

Another object of the invention is to provide a safety device for rendering handguns temporarily inoperative, in which a locking mechanism is used that requires substantial strength to manipulate, thereby rendering it child-resistant.

A further object of the invention is to provide a device for disabling a handgun, in which a strap extends from a block releasably secured on the end of the muzzle to behind the hammer or slide of the gun to prevent it from being fired, the block being secured in position by a snap detent that requires substantial strength to manipulate.

These and other objects of the invention are achieved by a simple and inexpensive device that may quickly and easily be removed by an adult to immediately render a firearm operable, but which is constructed such that a small child cannot remove the device and thereby create a dangerous situation. The device of the invention may be used with any handgun that has a hammer which must be cocked, including revolvers, and automatic or semi-automatic guns having a slide that must be manipulated to cock the gun. The device comprises three major components, i.e., a strap that extends behind the hammer or slide of the handgun, a block that lies against the end of the muzzle of the handgun and is fastened to the strap, and a removable plug that includes a pin which extends through the block and into the muzzle of the gun, thereby preventing displacement of the block from the muzzle. The plug is releasably secured to the block by interengaged detents which may be disengaged by squeezing the plug, thus permitting the plug and block to be displaced from the muzzle and the strap to be removed from behind the hammer or slide. The interengaged detents may not be released from one another unless the plug is squeezed, and the resistance to deflection of the plug is such that a small child cannot squeeze it to release the detents. So long as the device is in place on the firearm, it cannot be fired since the hammer (or slide) will not operate.

BRIEF DESCRIPTION OF THE DRAWINGS

The foregoing as well as other objects and advantages of the invention will become apparent from the following detailed description when considered in conjunction with the accompanying drawings, in which like reference characters designate like parts throughout the several views, and wherein.

DETAILED DESCRIPTION OF THE PREFERRED EMBODIMENTS

Figure 1:
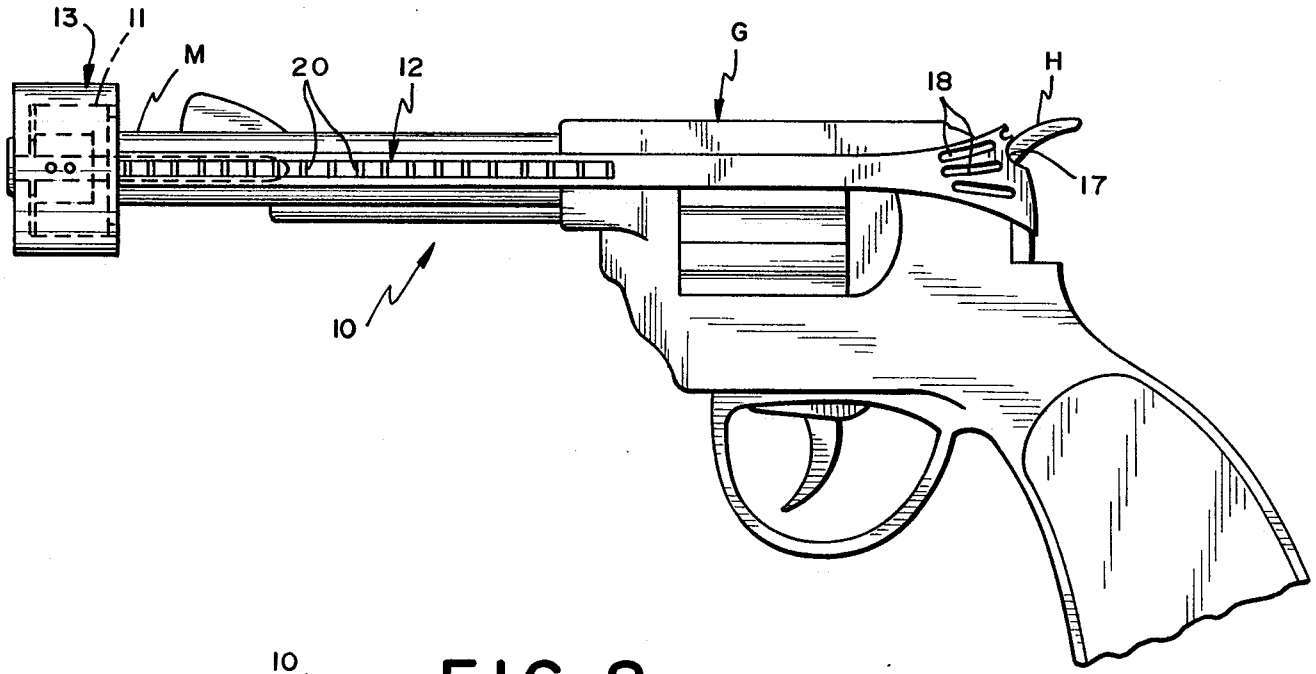
FIG. 1 is a side view in elevation of a handgun having the device of the invention applied thereto.
Figure 2:
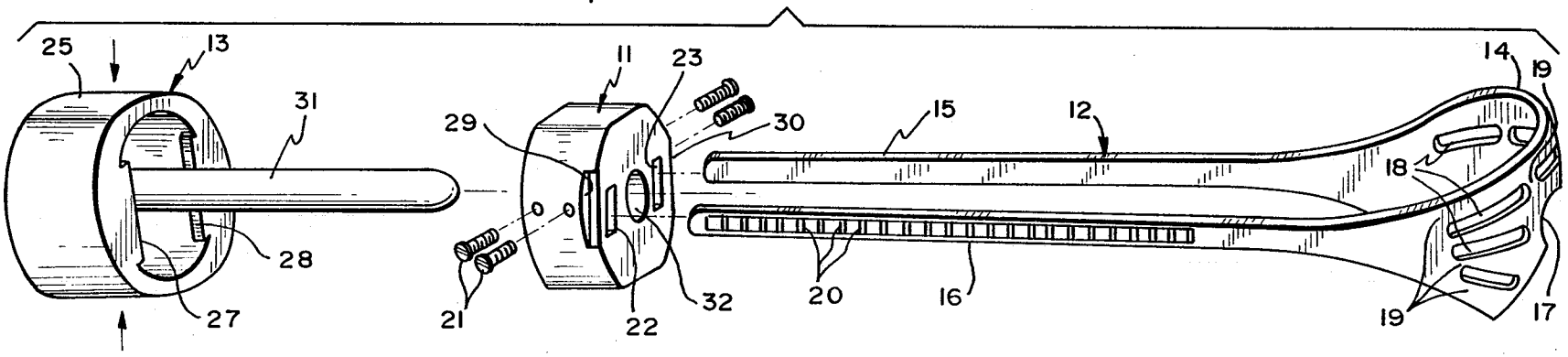
FIG. 2 is an exploded perspective view of the safety device of the invention.
Figure 5:
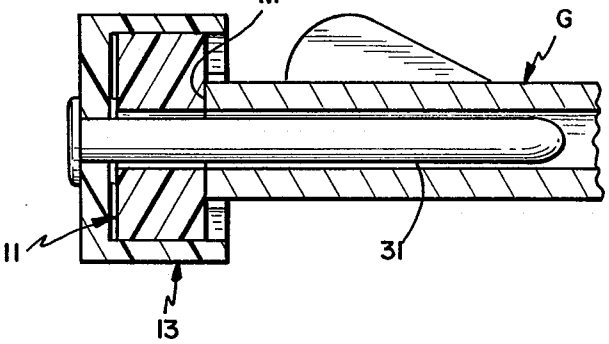
FIG. 5 is a fragmentary vertical sectional view showing the muzzle block and cap applied to the muzzle of a gun.
Figure 6:
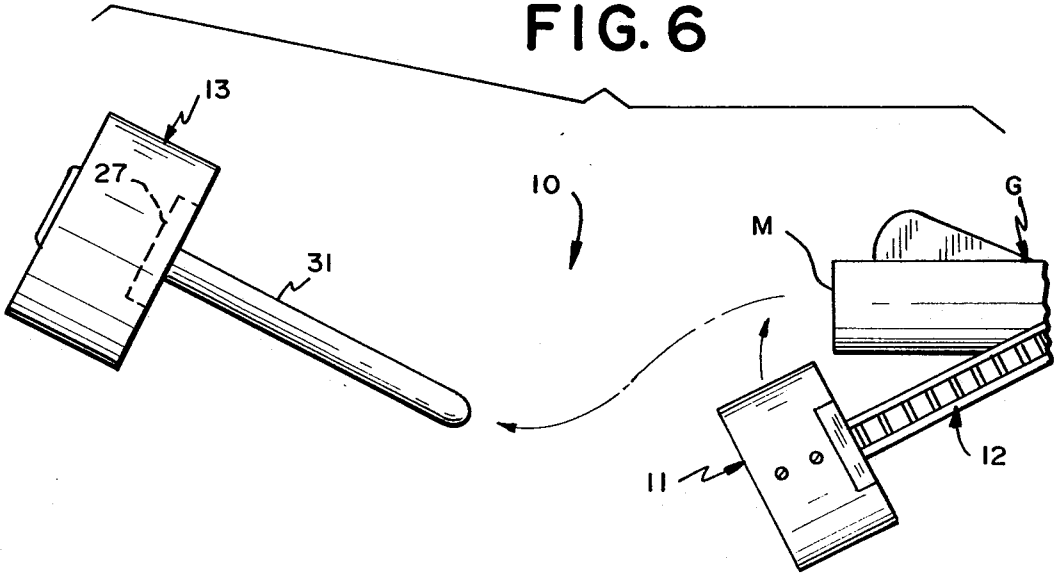
FIG. 6 is an exploded view showing how the device may be removed from the gun to render it operative.
Figure 3:
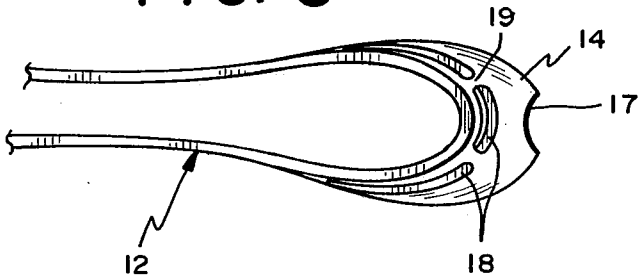
FIG. 3 is a fragmentary top plan view of a portion of the strap used in the device of the invention.

Referring more particularly to the drawings, a first form of the invention is represented generally at 10 in FIGS. 1–8. The invention comprises a muzzle block 11 engaged on the muzzle M of a handgun G, a strap 12 secured to the block and extending behind the hammer H of the gun, and a cap 13 releasably engaged on the block 11.

The strap 12 is generally sling-shaped in configuration and preferably comprises a tough, flexible material, such as nylon or the like. It includes a relatively wide bight portion 14 adapted to extend behind the hammer of the gun, and a pair of elongate arms 15 and 16 adapted to extend from the bight portion on opposite sides of the barrel of the gun to the block 11 on the muzzle. The bight portion 14 preferably has an opening 17 therethrough for receiving the hammer of the gun to prevent the strap from being slipped out of its position behind the hammer. A plurality of slots 18, or other suitable means, are formed in the bight portion to define frangible sections 19 that enable parts of the bight portion to be removed to adapt the strap to different styles and sizes of handguns. See FIG. 4.

The outer surfaces of the arms 15 and 16 have a plurality of notches or recesses 20 therein for cooperation with suitable fastening means, such as set screws 21 or the like extended through the sides of the block 11 to securely fasten the ends of the arms in the block.

The block 11 has a pair of openings 22 and 23 extending therethrough adjacent opposite sides for receiving the ends of the strap arms 15 and 16, whereby the fasteners 21 may be extended through the sides of the block and into engagement with the arms to secure them in the openings and thus secure the strap and block firmly in position with the block lying against the muzzle and the strap extending behind the hammer.

The cap 13 is generally cup-shaped and includes a side wall 25 adapted to telescope over the block, with an end wall 26 lying against the end of the block. A pair of diametrically opposed shoulders 27 and 28 are formed on the inner surface of the side wall 25 at its open end, and define detents adapted to snap engage in recesses 29 and 30 formed at the inner end of the block on opposite sides thereof to prevent removal of the cap from the block.

An elongate pin 31 is secured to the end wall 26 of the cap and extends forwardly therefrom through a central opening 32 formed in the block, and thence into the muzzle of the gun. This pin prevents lateral displacement of the block and/or cap from the end of the gun, and thereby prevents removal of the strap from behind the trigger. Consequently, the gun is rendered inoperable and cannot be fired.

However, as depicted in FIGS. 2, 6, 8 and 9, the cap side wall 25 may be flexed by squeezing on the top and bottom thereof, thereby causing the sides of the wall carrying the detents 27 and 28 to spring outwardly and disengaging the detents 27 and 28 from the recesses 29 and 30. This enables the cap to be pulled axially from the block, removing the pin from the block and muzzle, and permitting the block to be displaced laterally from the muzzle to free the strap from behind the hammer. This action may be quickly and easily accomplished by an adult while the gun is held in ready position in one hand, preparing it for immediate use. A small child, on the other hand, does not have adequate strength to squeeze the cap to release the detents, and therefore cannot fire the gun, either accidentally or intentionally.

Figure 4:
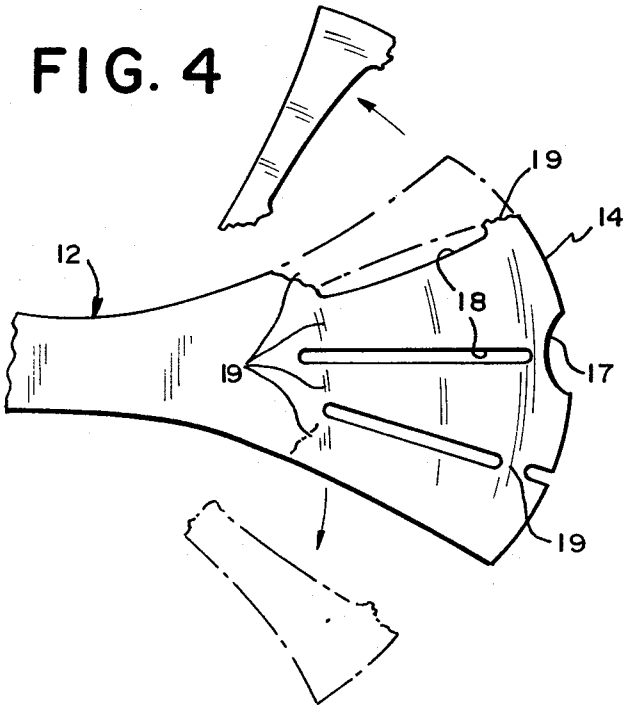
FIG. 4 is a greatly enlarged fragmentary view in side elevation showing how portions of the strap may be removed to adapt the device to different firearms.

By removing parts of the bight portion of the strap along the frangible sections, as shown in FIG. 4, for example, the strap can be adapted to different size and style handguns.

Figure 9:
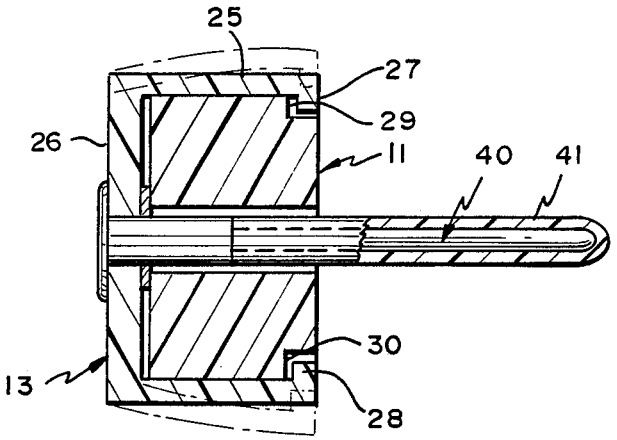
FIG. 9 is a horizontal sectional view of a first modification of the muzzle block and cap, showing how different size muzzle pin sleeves may be applied to the muzzle pin to render it suitable for use on different caliber guns, and showing the interengaged detents on the block and cap.
Figure 7:
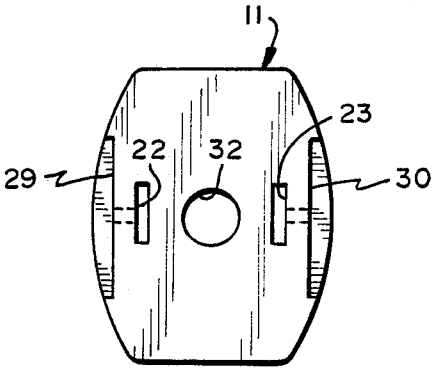
FIG. 7 is an end view of the muzzle block, showing the openings for receiving the muzzle pin and the ends of the strap, and also showing the recesses for engagement with the shoulders on the cap.
Figure 8:
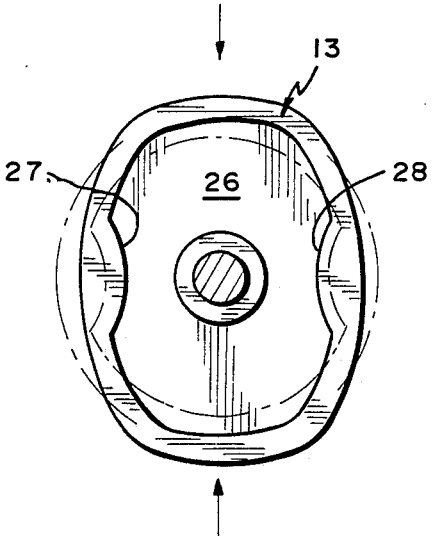
FIG. 8 is a somewhat schematic end view of the cap, showing how it is squeezed to release the shoulders from the recesses on the block.

Moreover, as shown in FIG. 9, the pin 40 can be designed with a relatively small diameter, suitable for insertion into the muzzle of a .22 caliber handgun, for example, and different sleeves 41 can be slipped onto the pin 40 to make it have a close fit in larger caliber handguns.

Figure 10:
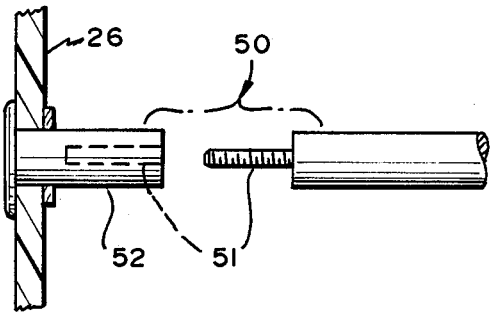
FIG. 10 is a fragmentary exploded sectional view of a second modification of the invention, showing a portion of the cap and muzzle pin, in which different diameter pins may be substituted on the cap for adapting the device to guns of different caliber.

In the modification shown in FIG. 10, different diameter pins 50 can be provided for releasable attachment to the cap through a threaded connection 51 in a stud 52 affixed to the cap, thereby making the device adaptable to guns of different caliber.

As previously noted, the strap, block and cap are preferably made of a suitably hard material, such as plastic, and nylon in particular, while the pin may suitably comprise a metallic material, such as brass. The invention is equally adaptable to revolvers having exposed hammers or to semiautomatic pistols of the type having slides which must be manipulated to prepare the handgun for firing.

Although the invention has been described with reference to particular embodiments, it is to be understood that these embodiments are merely illustrative of the application of the principles of the invention. Numerous modifications may be made therein and other arrangements may be devised without departing from the spirit and scope of the invention.

I claim:

1. A child-resistant safety device for attachment to firearms having a barrel with a muzzle and a cocking mechanism such as a hammer, for temporarily rendering the firearm inoperative, comprising:

a block adapted to lie against the muzzle of the firearm;

a strap having a first portion adapted to extend behind the cocking mechanism of the firearm, and a second portion adapted to extend from the first portion to the block;

means for securing the strap to the block with the strap held firmly behind the hammer to prevent its operation and thus prevent operation of the firearm; and releasable means secured on the block through interengaged detent means to prevent removal of the block from the muzzle and thus prevent removal of the strap from the cocking mechanism, said releasable means being removable from the block upon disengagement of the detent means, whereby the block and strap may be removed from the firearm to enable it to be fired.

2. A safety device as claimed in claim 1, wherein:

the releasable means includes a pin which is adapted to extend through the block and into the muzzle of the gun to prevent lateral displacement of the block from the muzzle.

3. A safety device as claimed in claim 2, wherein:

the releasable means comprises a cup-shaped cap which fits telescopically over the block; and the detent means comprises interengaged shoulder and recess means on the cap and block, arranged to hold the cap telescoped over the block.

4. A safety device as claimed in claim 3, wherein:

the cap has a cylindrical side wall, with a closed end and an open end; and said detent means comprises radially inwardly protruding shoulders on the open end of the side wall at diametrically opposed sides thereof, said side wall formed of a flexible material so that the cap may be squeezed to flex the wall and disengage the shoulders from mating recesses on the block.

5. A safety device as claimed in claim 1, wherein:

said strap is generally sling-shaped in configuration, including a bight portion and a pair of elongate arms extending therefrom, said bight portion comprising the first portion and the arms comprising the second portion; and said bight portion has means defining frangible sections whereby parts of the bight portion may be removed to adapt the strap to firearms of different size and style.

6. A safety device as claimed in claim 5, wherein:

said arms have free end portions which extend into openings in the block; and separate fastening means extend through the block and into engagement with the arms to secure them to the block.

7. A safety device as claimed in claim 6, wherein:

the bight portion has an opening therethrough for receipt of a hammer on the firearm to which the device is adapted to be attached, preventing lateral displacement of the strap from the hammer.

8. A safety device as claimed in claim 7, wherein:

the releasable means includes a pin which is adapted to extend through the block and into the muzzle of the gun to prevent lateral displacement of the block from the muzzle.

9. A safety device as claimed in claim 8, wherein:

the releasable means comprises a cup-shaped cap which fits telescopically over the block; and the detent means comprises interengaged shoulder and recess means on the cap and block, arranged to hold the cap telescoped over the block.

10. A safety device as claimed in claim 9, wherein:

the cap has a cylindrical side wall, with a closed end and an open end; and said detent means comprises radially inwardly protruding shoulders on the open end of the side wall at diametrically opposed sides thereof, said side wall formed of a flexible material so that the cap may be squeezed to flex the wall and disengage the shoulders from mating recesses on the block.

11. A safety device as claimed in claim 2, wherein:

said pin includes interchangeable means to enable the pin to be adapted to firearms of different caliber.

12. A safety device as claimed in claim 11, wherein:

the interchangeable means comprises a replaceable sleeve which fits over the pin to change the diameter of the pin.

13. A safety device as claimed in claim 11, wherein:

the interchangeable means comprises a releasable connection on the pin to enable pins of different diameter to be substituted.

* * * * *